United States Patent [19]

Meyer

[11] 4,199,934

[45] Apr. 29, 1980

[54] COMBUSTION CHAMBER, ESPECIALLY FOR GAS TURBINES

[75] Inventor: Franz-Josef Meyer, Marbach, Fed. Rep. of Germany

[73] Assignee: Daimler-Benz Aktiengesellschaft, Fed. Rep. of Germany

[21] Appl. No.: 932,547

[22] Filed: Aug. 10, 1978

Related U.S. Application Data

[62] Division of Ser. No. 705,530, Jul. 15, 1976, abandoned.

[30] Foreign Application Priority Data

Jul. 24, 1975 [DE] Fed. Rep. of Germany ..... 2533115

[51] Int. Cl.[2] ..... F02C 7/22

[52] U.S. Cl. ..... 60/39.23; 60/737; 60/39.72 R; 60/749

[58] Field of Search ..... 60/39.69, 39.71, 39.74 R, 60/39.65, 39.72 R, 39.23; 431/351-353, 173, 189, 177, 186; 239/432

[56] References Cited

U.S. PATENT DOCUMENTS

| | | | |
|---|---|---|---|
| 2,142,601 | 1/1939 | Bleecker | 60/39.72 R |
| 2,920,449 | 1/1960 | Johnson et al. | 60/39.74 R |
| 3,306,333 | 2/1967 | Mock | 60/39.74 R |
| 3,530,667 | 9/1970 | Bryan | 60/39.74 R |
| 3,724,207 | 4/1973 | Johnson | 60/39.74 R |
| 4,078,377 | 3/1978 | Owens et al. | 60/39.71 |

*Primary Examiner*—Robert E. Garrett
*Attorney, Agent, or Firm*—Craig and Antonelli

[57] ABSTRACT

A combustion chamber having an end-wall at the inlet side and an axial inlet opening, which is adjoined by an essentially cylindrical wall section provided with secondary air inlet openings; the end-wall thereby adjoins the inlet opening approximately hemispherically shaped with a sphere diameter which is larger than the diameter of the cylindrical wall section while the adjoining combustion chamber portion is again reduced to the adjacent cylindrical wall section by way of a combustion chamber wall substantially continuing the sphere shape; the fuel injection device is provided upstream of the inlet opening which injects fuel into the inlet opening, itself covered off by a deflection means.

17 Claims, 2 Drawing Figures

COMBUSTION CHAMBER, ESPECIALLY FOR GAS TURBINES

Figure 1:
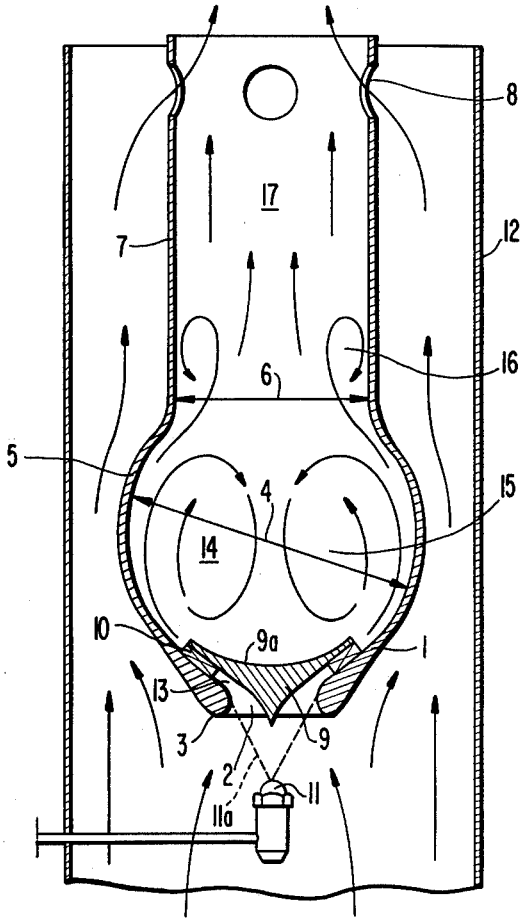

The present invention relates to a combustion chamber with an approximately chalice-shaped or cup-shaped inlet-side-end-wall provided with an axial inlet opening, which is adjoined by an essentially cylindrical wall section with secondary air inlet openings, and with a fuel injection device and with an installation for the supply of preheated combustion air arranged upstream of the axial inlet opening whereas an approximately mushroom-shaped deflection member for radially spreading out the fuel-air mixture flowing into the combustion chamber along the end-wall, which is retained at the inner wall of the end-wall, for example, by webs distributed along its circumference, is provided axially inside the inlet opening and further concentric deflection means for recombining the mixture in the sense of the formation of an annular swirl or vortex are provided inside of the combustion chamber downstream of the deflection member, especially for gas turbines.

For purposes of a combustion which is as low in harmful components as possible, one should aim at introducing the fuel-air mixture into the combustion chamber already with a relatively high temperature, which can be achieved either by a high air-compression or by a preheating of the combustion air by the exhaust gases of the turbine or by both measures in common, and then at stimulating the mixture in the combustion chamber into an annular swirl or vortex, within which takes place the entire combustion. With a combustion chamber of the aforementioned type as described in the German Offenlegungsschrift No. 2,415,036, an axial inlet channel additionally starts from the inlet opening of the inlet-side end-wall, whereby the fuel injection device is arranged in the inlet-side opening thereof. At the place of the inlet opening, the inlet channel passes over into the end-wall of the combustion chamber which, as to the rest, is enlarged funnel-shaped, by way of a connecting portion rounded-off in cross section along a radius of curvature. As a result of the deflection surface of the deflection member matched to the curvature of the connecting portion, the inflowing fuel-air mixture is spread apart along the walls of the end-wall. In order that an annular vortex or swirl of the mixture can now be formed in the adjoining cylindrical part of the combustion chamber, several blades distributed in the circumferential direction are now mounted at the inner surface of the cylindrical wall portion near the aforementioned end-wall, which on the outlet side are each curved inwardly along a quarter of a circle. However, it is disadvantageous with this prior art combustion chamber that the blades provided for the stimulation or excitation of the mentioned annular vortex or swirl, on the one hand, can seize only a part of the mixture and, on the other, can hardly withstand over longer periods of time the very high combustion temperatures.

The present invention is concerned with the task to achieve the annular swirl which is so advantageous for the combustion low in harmful components, to the extent possible without any parts projecting radially into the reaction area of the combustion chamber, at the same time in a more complete manner than is possible with the aforementioned prior art combustion chamber.

The underlying problems are solved according to the present invention in that the inlet-side end-wall adjoins the inlet opening approximately hemispherically with a sphere diameter larger compared to the diameter of the cylindrical wall section and the adjoining combustion chamber portion is again reduced to the adjoining cylindrical wall section by means of a wall portion continuing the spherical shape.

With such a construction of the combustion chamber wall, a rotary component in the sense of the formation of the desired annular swirl is imparted to the mixture spread apart by the deflection body, already along the end-wall adjoining the inlet opening, which swirl then continues to be further formed far-reachingly by the adjoining wall area of the combustion chamber which is curved more than hemispherically shaped and in its turn forms a further deflection means in such a manner that the aimed-at annular swirl is already completely formed without any parts projecting into the reaction space.

According to one embodiment of the present invention, the edge of the inlet opening is provided with a streamlined, approximately drop-shaped cross-sectional form and the injection device has a jet direction along the generatrices of a cone approximately tangential to the inner edge of the inlet opening, whence a very homogeneous mixture preparation and an evaporation of the mixture results inside of the annular space between the deflection member and the area of the end-wall adjoining the inlet opening, which leads subsequently to a quasihomogeneous combustion in the combustion chamber improving the emission behavior.

According to a further feature of the present invention, the end-face of the deflection member facing the interior space of the combustion chamber has a concavely curved configuration approximately matched to the spherical shape of the end wall, by means of which the formation of the annular swirl initiated by the outer wall of the combustion chamber is further assisted.

According to another embodiment of the present invention, the deflection member is secured at a support member of the atomizer nozzle by way of bars or rods extending axially parallel through the inlet opening. By virtue of this arrangement, an annular gap formed between the inner portion of the end-wall and the deflection member is adjustable so as to split up the air supplied to the combustion chamber in an optimum manner at any prevailng optimum condition of the combustion chamber.

It is already known from the German Offenlegungsschrift No. 2,345,282 to impart to the fuel-air mixture within a combustion chamber having an approximately hemispherically shaped inlet-side end-wall and provided with an axial inlet opening, an annularly-shaped swirl movement by means of an approximately mushroom-shaped axial deflection member; nonetheless this construction has nothing to do with the present invention because the deflection member is located in this Offenlegungsschrift approximately in the center of the sphere of the hemispherically shaped end-wall at the end of a burner-pipe projecting from the end-wall axially into the combustion space and thus the burner-pipe forms a part projecting into the reaction area, which can be protected against an excessive heating only by an outer cooling-jacket and by additional unmixed air flowing through the same. Not only the larger constructive expenditures but also the shortcoming that an excessively rich mixture has to be supplied initially to the combustion chamber, is contrary in this prior art construction to the exclusive supply of a quasi-homogeneous fuel-air mixture into the combustion chamber as proposed by the present invention. Furthermore, it is additionally disadvantageous with this prior art combustion chamber that with the supply of an air mixture excessively saturated with fuel, the formation of a second annular swirl is provided also on the outlet-side of the mentioned annular swirl, in which an after-burning is to take place in connection with the secondary air supplied thereat. However, based on experience, the correct further-thinning of an excessively rich mixture with secondary air can be controlled only with difficulty in such a manner that the desired complete combustion is assured.

Accordingly, it is an object of the present invention to provide a combustion chamber, especially for gas turbines, which avoids by simple means the aforementioned shortcomings and drawbacks encountered in the prior art.

Another object of the present invention resides in a combustion chamber which produces an improved combustion resulting in relatively very small quantities of harmful components.

A further object of the present invention resides in a combustion chamber which assures a long length of life without the need for replacement of parts.

Still a further object of the present invention resides in a combustion chamber, in which endangered parts exposed to the high combustion temperatures, are eliminated.

Another object of the present invention resides in a combustion chamber, especially for gas turbines, which makes it possible to attain an annular swirl without parts projecting into the reaction area of the combustion chamber.

Still another object of the present invention resides in a combustion chamber in which a quasi-homogeneous combustion is achieved without the need of supplying at any time an excessively enriched mixture.

Figure 2:
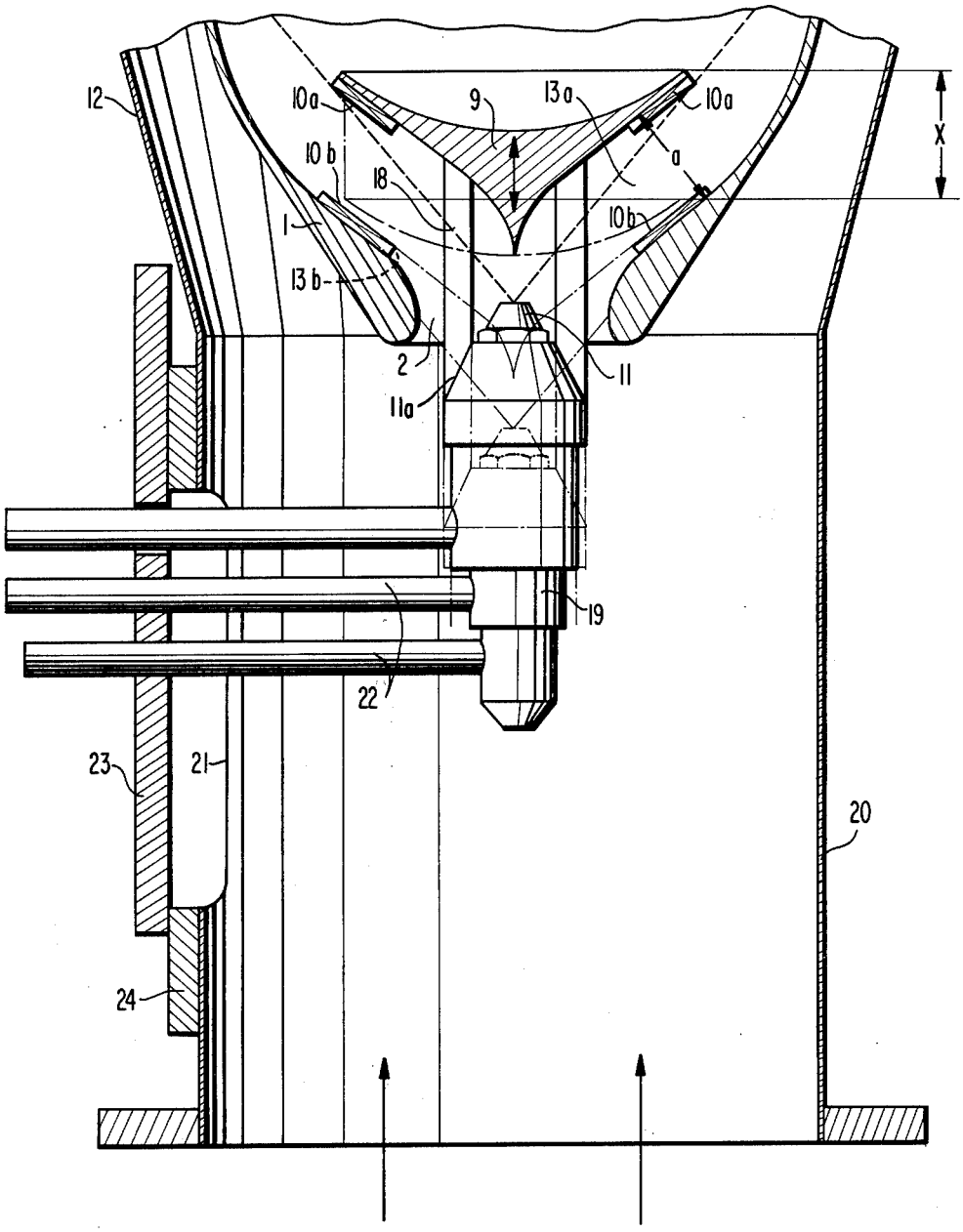

These and other objects, features and advantages of the present invention will become more apparent from the following description when taken in connection with the accompanying drawing which shows, for purposes of illustration only, two embodiments in accordance with the present invention, and wherein:

FIG. 1 is a schematic axial cross-sectional view through a combustion chamber in accordance with the present invention; and FIG. 2 is a schematic, partial axial cross-sectional view, on an enlarged scale compared to FIG. 1 of a modified embodiment of a combustion chamber construction in accordance with the present invention.

Referring now to the drawing wherein like reference numerals are used throughout the two views to designate like parts, the combustion chamber illustrated in FIG. 1, includes an approximately hemispherically-shaped inlet-side end-wall 1, in which an inlet opening 2 for the fuel-air mixture to be combusted is provided axially thereof. The edge 3 of the inlet opening 2 has an approximately drop-shaped cross section favorable from a streamlining point of view and the spherical shape of the end-wall 1 is again reduced on the outlet side at a point beyond the largest cross section corresponding to the sphere diameter 4 by way of a wall portion 5 containing the sphere shape, to the smaller diameter 6 of a cylindrical wall section 7 adjoining the sphere on the outlet side, which diameter 6 is smaller compared to the diameter 4 of the sphere. Within the area of its end on the outlet side, the wall section 7 is then finally provided with openings 8 for secondary air arranged distributed along its circumference, which serve exclusively for a thinning-out and a corresponding cooling-down of the exhaust gases of the combustion chamber of a gas turbine (not shown).

It can further be seen from FIG. 1 that an approximately mushroom-shaped deflection member 9 is arranged inside of the inlet opening 2 and simultaneously projecting into the combustion chamber, which deflection member is larger than the inlet opening 2. It is secured at the end wall 1 by webs 10 which extend each approximately radially and are arranged distributed along its circumference. Additionally, the end-surface 9*a* of the deflection member 9 facing the interior space of the combustion chamber has a concavely curved configuration matched approximately to the spherical shape of the end wall 1.

Finally, it can be seen from FIG. 1 that a fuel injection mechanism with an atomizer nozzle 11 is provided axially upstream of the inlet opening 2 which has a jet direction extending along the generatrices of a cone 11*a* approximately tangential to the inner edge of the inlet opening 2.

During the operation of the combustion chamber, all of the air which is heated either by reason of a compression ratio of, for example, more than 20:1 and/or by reason of a preheating by the gas turbine exhaust gases to a temperature of about 400° C. or more flows axially into the combustion chamber through a pipe or tubular member 12 past the atomizer nozzle 11, whereby a splitting up into primary combustion air which flows into the combustion chamber 1 through the inlet opening 2, and into secondary air which circumcirculates the end wall 1 from the outside of the edge 3, takes place by the edge 3 of the inlet opening 2. Fuel is injected from the injection nozzle 11 into the primary combustion air whereby the fuel jet is deflected with respect to the illustrated jet direction along the surface of the cone 11*a* by the primary air flowing into the inlet opening 2 so far in the direction toward the combustion chamber axis that exactly an optimum mixing of the fuel with the preheated combustion air results. By reason of this mixing and the high air temperature, one can count on the fact that the fuel, when leaving the annular gap 13 between the end-wall 1 and the mushroom-shaped deflection member 9, has already evaporated for the most part and therewith a quasi-homogeneous combustion is possible which effects an improvement of the emission behavior. The evaporation of the fuel is thereby additionally assisted by the very high temperature of the deflection member 9 which is heated-up from the inside of the combustion chamber, within which the reaction and combustion of the fuel-air mixture takes place in direct proximity of the deflection member 9.

A large annular swirl 15 forms in the spherically shaped reaction space 14 formed by the end-wall 1 and the adjacent wall portion 5 of the combustion space, which assures a wide stability area of the flame and therewith permits also the combustion of very lean mixtures, which is advantageous with a view toward a slight nitrogen-oxide formation. A further annular swirl 16 forms downstream of the transition from the reaction space 14 into the adjoining cylindrical section 17 of the combustion chamber. This annular swirl 16 assures a good degree of combustion of the mixture flowing along the inner wall of the spherically shaped reaction space 14. At the outlet-side end of the cylindrical section 17 of the combustion chamber the secondary air flows through the opening 8 into the combustion chamber and takes care for a reduction of the exhaust gas temperature of the combusted mixture to a temperature acceptable for loading or stressing an adjacent turbine rotor (not shown).

The relatively large reaction space 14 of the described combustion chamber produces also with lean mixtures and correspondingly low nitrogen oxide formation a high degree of complete combustion and therewith low carbon-monoxide-and hydrocarbon-emissions.

In the modified embodiment of the combustion chamber illustrated in FIG. 2, the deflection member 9 is not secured at the end-wall 1 but instead at a support member 19 of the atomizer nozzle 11 by way of rods or bars 18 extending axially parallelly through the inlet opening 2. The support member 19 is retained at a cover member 23 covering a circumferential openig 21, by means of retaining rods 22 extending transversely toward the outside through the circumferential opening 21 by way of air channel 20 adjoining the pipe 12 on the inlet side thereof. The cover member 23 is thereby longitudinally displaceable axially parallel to the combustion chamber with respect to the circumferential wall 24 of the air channel 20 over the axial length of the circumferential opening 21 and is adapted to be fixed in any selected position by conventional means. It can thereby be seen from FIG. 2 that the deflection member 9, in the illustrated most forward end position of the injection nozzle 11, leaves open a rather large annular gap 13*a* having a width a with respect to the end-wall 1. If, however, the atomizer nozzle 11 is retracted by the maximum adjusting path X of the deflection member 9, then only a very narrow annular gap 13*b* is left open between the deflection member 9 and the end-wall 1 whose width corresponds to the width of the auxiliary webs 10*a* and 10*b* at the deflection member 9 and at the end-wall 1.

The possibility is created by such an adjustability of the annular gap 13 to split up the air supplied to the combustion chamber in an optimum manner into combustion and cooling air, i.e., with a corresponding adjustability of the axial position of the atomizer nozzle 11, to split up the air supplied to the combustion also at any prevailing operating condition of the combustion chamber into combustion air and cooling air.

As to the rest, the illustrated flow conduction is not limited to pipe or tubular combustion chambers; instead, it can also be applied with similar advantages to annular combustion chambers, in which case the annular swirl fills out the entire inlet side annular reaction space of the annular combustion chamber. In that case one only needs to observe that with annular combustion chambers, another mixture supply matched to the annular combustion chamber takes the place of the illustrated fuel injection. In this case, several inlet openings with one coordinated atomizer nozzle each, for example, along the end-face circumference of the annular combustion chamber may be appropriately arranged along the inner edge area of the annular combustion chamber whereby the deflection members then merely have a half-mushroon-shaped configuration each and in contrast to the deflection member illustrated herein which already by itself produces a complete annular swirl as a result of the mushroon-shaped spreading out of the mixture flow now excite respectively annular sections of the annular swirl whose circumferential length is now determined by mutual distance of the While I have shown and described only two embodiments in accordance with the present invention, it is understood that the same is not limited thereto but is susceptible of numerous changes and modifications as known to those skilled in the art and I therefore do not wish to be limited to the details shown and described herein but intend to cover all such changes and modifications as are encompassed by the scope of the appended claims.

I claim:

1. A combustion chamber with an end-wall means having an axial inlet opening on an inlet side thereof, a first wall portion downstream of the end-wall means provided with secondary air inlet openings, means for supplying preheated combustion air into the combustion chamber, fuel injection means including a fuel injection nozzle disposed upstream of the inlet opening for injecting fuel into the preheated combustion air, first deflection means disposed essentially axially inside of the inlet opening for radially spreading out the fuel-air mixture flowing into the combustion chamber along the end-wall means, and second deflection means on the inside of the combustion chamber downstream of the first deflection means for forming an annular swirl so as to recombine the fuel-air mixture, characterized in that means are provided for mounting the first deflection means inside of the inlet opening so as to be axially adjustable with respect to the combustion chamber, and in that means are provided for supporting the injection nozzle so as to be axially adjustable with respect to the inlet opening of the combustion chamber.

2. A combustion chamber according to claim 1, characterized in that said means for mounting the first deflection means includes bar means for fixedly mounting the first deflection means at the supporting means, said bar means extend from the supporting means through the inlet opening to the first deflection means.

3. A combustion chamber according to claim 1, with an end-wall means having an axial inlet opening on the inlet side thereof, a first wall portion downstream of the end-wall means and provided with secondary air inlet openings, fuel injection means upstream of the inlet opening, means for supplying preheated combustion air, first deflection means disposed essentially axially inside of the inlet opening for radially spreading out the fuel-air mixture flowing into the combustion chamber along the end-wall means, and second deflection means on the inside of the combustion chamber downstream of the first deflection means for recombining the mixture in the sense of the formation of an annular swirl, characterized in that the end-wall means at the inlet side adjoins the inlet opening approximately hemispherically-shaped with a sphere diameter larger than a diametric dimension of the first wall portion, and in that a part of the combustion chamber adjoining the hemispherically-shaped end-wall means is reduced by way of a second wall portion approximately continuing the spherical shape to the adjacent first wall portion.

4. A combustion chamber according to claim 3, characterized in that the first deflection means is approximately mushroom-shaped and the first wall portion is substantially cylindrical.

5. A combustion chamber according to claim 4, characterized in that webs are distributed along a circumference of at least one of the first deflection means and an inner wall of the end-wall means.

6. A combustion chamber according to claim 1, characterized in that an edge of the inlet opening has a streamlined cross-sectional shape, and in that the fuel injection nozzle has a jet direction along generatrices of a cone approximately tangential to an inner edge of the inlet opening at a middle position of an axial adjustment of the first deflection means.

7. A combustion chamber according to claim 6, characterized in that the cross-sectional shape of the edge of the inlet opening is approximately drop-shaped.

8. A combustion chamber according to claim 1, characterized in that an end surface of the first deflection means facing an interior space of the combustion chamber has a concave configuration approximately matched to the a shape of the end-wall means.

9. A combustion chamber with an end-wall means having an axial inlet opening on an inlet side thereof, a first wall portion downstream of the end-wall means provided with secondary air inlet openings, means for supplying preheated combustion air into the combustion chamber, fuel injection means disposed upstream of the inlet opening for injecting fuel into the preheated combustion air, first deflection means disposed essentially axially inside of the inlet opening for radially spreading out the fuel-air mixture flowing into the combustion chamber along the end-wall means, and second deflection means on the inside of the combustion chamber downstream of the first deflection means for forming an annular swirl so as to recombine the fuel-air mixture, characterized in that means are provided for mounting the first deflection means inside of the inlet opening so as to be axially adjustable with respect to the combustion chamber, an edge of the inlet opening has a streamlined cross-sectional shape, the fuel injection means has a jet direction along generatrices of a cone approximately tangential to an inner edge of the inlet opening at a middle position of an axial adjustment of the first deflection means, and in that approximately radially extending webs are distributed along a circumference of at least one of the first deflection means and an inner wall of the end-wall means.

10. A combustion chamber with an end-wall means having an axial inlet opening on an inlet side thereof, a first wall portion downstream of the end-wall means provided with secondary air inlet openings, means for supplying preheated combustion air into the combustion chamber, fuel injection means disposed upstream of the inlet opening for injecting fuel into the preheated combustion air, first deflection means disposed essentially axially inside of the inlet opening for radially spreading out the fuel-air mixture flowing into the combustion chamber along the end-wall means, and second deflection means on the inside of the combustion chamber downstream of the first deflection means for forming an annular swirl so as to recombine the fuel-air mixture, characterized in that means are provided for mounting the first deflection means inside of the inlet opening so as to be axially adjustable with respect to the combustion chamber, means are provided for supporting the fuel injection means so as to be axially adjustable with respect to the combustion chamber, said means for mounting the first deflection means includes a bar means for fixedly mounting the first deflection means at the supporting means, said bar means extend from the supporting means through the inlet opening to the first deflection means, an annular gap is formed between the end-wall means and the first deflection means, and in that at least one of the first deflection means and the end-wall means carry auxiliary webs projecting into said annular gap.

11. A combustion chamber according to claim 10, characterized in that means are provided for controlling the axial position of the injection nozzle of the fuel injection means in dependence upon the operating conditions of the combustion chamber.

12. A combustion chamber according to claim 9, characterized in that the first deflection means is approximately mushroom-shaped and the first wall portion is substantially cylindrical.

13. A combustion chamber according to claim 10, characterized in that an end surface of the first deflection means facing an interior space of the combustion chamber has a concave configuration approximately matched to the a shape of the end-wall means.

14. A combustion chamber with an end-wall means having an axial inlet opening on an inlet side thereof, a first wall portion downstream of the end-wall means provided with secondary air inlet openings, means for supplying preheated combustion air into the combustion chamber, fuel injection means disposed upstream of the inlet opening for injecting fuel into the preheated combustion air, first deflection means disposed essentially axially inside of the inlet opening for radially spreading out the fuel-air mixture flowing into the combustion chamber along the end-wall means, and second deflection means on the inside of the combustion chamber downstream of the first deflection means for forming an annular swirl so as to recombine the fuel-air mixture, characterized in that means are provided for mounting the first deflection means inside of the inlet opening so as to be axially adjustable with respect to the combustion chamber, and in that approximately radially extending webs are distributed along a circumference of at least one of the first deflection means and an inner wall of the end-wall means.

15. A combustion chamber according to claim 3, characterized in that said means for mounting the first deflection means includes bar means for fixedly mounting the first deflection means at the supporting means, said bar means extend from the supporting means through the inlet opening to the first deflection means.

16. A combustion chamber with an end-wall means having an axial inlet opening on an inlet side thereof, a first wall portion downstream of the end-wall means provided with secondary air inlet openings, means for supplying preheated combustion air into the combustion chamber, fuel injection means disposed upstream of the inlet opening for injecting fuel into the preheated combustion air, first deflection means disposed essentially axially inside of the inlet opening for radially spreading out the fuel-air mixture flowing into the combustion chamber along the end-wall means, and second deflection means on the inside of the combustion chamber downstream of the first deflection means for forming an annular swirl so as to recombine the fuel-air mixture, characterized in that means are provided for mounting the first deflection means inside of the inlet opening so as to be axially adjustable with respect to the combustion chamber, means are provided for supporting the fuel injection means so as to be axially adjustable with respect to the combustion chamber, said means for mounting the first deflection means includes bar means for fixedly mounting the first deflection means at the supporting means, said bar means extend from the supporting means through the inlet opening to the first deflection means, an annular gap is formed between the end-wall means and the first deflection means, and in that at least one of the first deflection means and the end-wall means carry auxiliary webs projecting into said annular gap between the end-wall means and the first deflection means.

17. A combustion chamber according to claim 15, characterized in that means are provided for controlling an axial position of an injection nozzle of the fuel injection means in dependence upon the operating conditions of the combustion chamber.

* * * * *